US010559885B2

(12) United States Patent
Morgan

(10) Patent No.: US 10,559,885 B2
(45) Date of Patent: Feb. 11, 2020

(54) DOUBLE-RIDGED WAVEGUIDE HORN ANTENNA

(71) Applicant: Associated Universities, Inc., Washington, DC (US)

(72) Inventor: Matthew Alexander Morgan, Earlysville, VA (US)

(73) Assignee: Associated Universities, Inc., Washington, DC (US)

( * ) Notice: Subject to any disclaimer, the term of this patent is extended or adjusted under 35 U.S.C. 154(b) by 0 days.

(21) Appl. No.: 16/256,673

(22) Filed: Jan. 24, 2019

(65) Prior Publication Data

US 2019/0173189 A1 Jun. 6, 2019

Related U.S. Application Data

(62) Division of application No. 15/518,656, filed as application No. PCT/US2016/034573 on May 27, 2016, now Pat. No. 10,199,735.

(60) Provisional application No. 62/167,687, filed on May 28, 2015.

(51) Int. Cl.

| | |
|---|---|
| ***H01Q 13/06*** | (2006.01) |
| ***H01Q 13/02*** | (2006.01) |
| ***H01P 5/103*** | (2006.01) |
| *H01P 3/123* | (2006.01) |

(52) U.S. Cl.

CPC ..... *H01Q 13/0275* (2013.01); *H01P 5/103* (2013.01); *H01Q 13/06* (2013.01); *H01P 3/123* (2013.01)

(58) Field of Classification Search

CPC ..... H01Q 13/0275; H01Q 13/06
USPC ..... 343/786
See application file for complete search history.

(56) References Cited

U.S. PATENT DOCUMENTS

| | | | | |
|---|---|---|---|---|
| 4,424,496 | A | 1/1984 | Nichols et al. | |
| 5,502,372 | A | 3/1996 | Quan | |
| 10,199,735 | B2 * | 2/2019 | Morgan | H01Q 13/0275 |
| 2014/0347073 | A1 | 11/2014 | Brown | |
| 2016/0049733 | A1 * | 2/2016 | Dunning | H01P 1/161 343/756 |

OTHER PUBLICATIONS

PCT Search Report and Written Opinion for PCT/US16/034573 dated Mar. 30, 2017.

Morgan, "A 10-100 Ghz Coax to Double-Ridged Wavedguide Launcher and Horn Antenna," arXiv preprint, Mar. 2015, content uploaded Apr. 3, 2015, pp. 2-3.

* cited by examiner

*Primary Examiner* — Peguy Jean Pierre
(74) *Attorney, Agent, or Firm* — Remenick PLLC

(57) ABSTRACT

A TEM line to double-ridged waveguide launcher and horn antenna are disclosed. The launcher uses multiple probes or one or more wide-aspect probes across the ridge gap to minimize spreading inductance and a TEM combiner or matching taper to match the impedance of the probes over a broad bandwidth. The horn uses a power-law scaling of gap height relative to the other dimensions of the horn's taper in order to provide a monotonic decrease of cutoff frequencies in all high-order modes. Both of these techniques permit the implementation of ultra-wideband designs at high frequencies where fabrication tolerances are most difficult to meet.

15 Claims, 6 Drawing Sheets

COMPLETED HORN ASSEMBLY

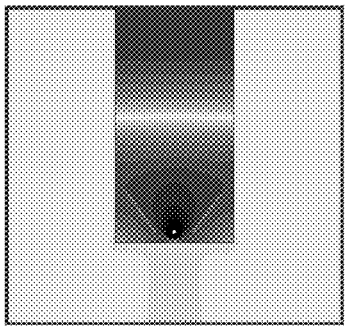

Figure 1. Illustration of the current density on the surface of one ridge in a double-ridged waveguide launcher near a single excitation probe (top-down view).

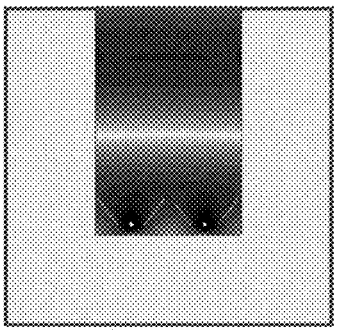

Figure 2. Illustration of the current density on the surface of one ridge in a double-ridged waveguide launcher near two excitation probes (top-down view).

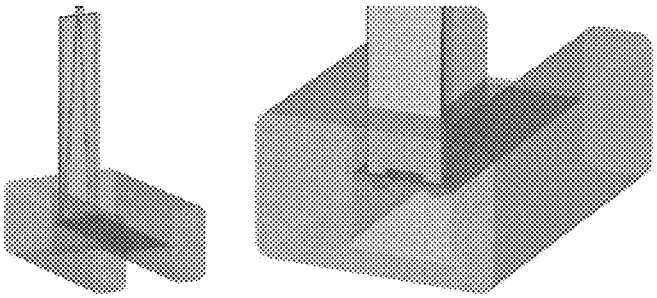

Figure 3. Model of two-probe launcher with impedance-matching combiner in microstrip.

SIMULATED PERFORMANCE OF TWO-PROBE LAUNCHER DESIGN

LAUNCHER ASSEMBLY WITH QUARTZ SPLITTER

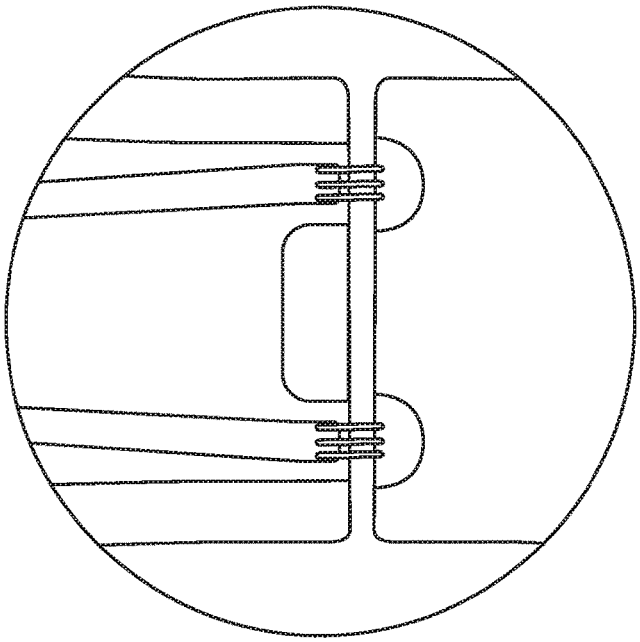

CLOSE-UP OF BOND-WIRE COUPLING POSTS CROSSING THE RIDGE GAP

FIG. 6

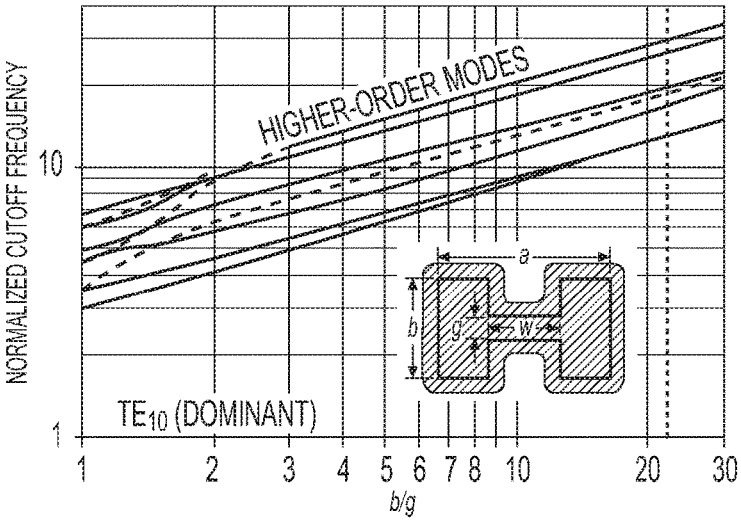

MODE CUTOFF FREQUENCIES VERSUS GAP HEIGHT RATIO (*b/g*) FOR DOUBLE-RIDGED WAVEGUIDE, NORMALIZED TO THE CUTOFF OF THE DOMINANT MODE. *a/b*=1.7 AND *w/b*=0.7. MODES WHICH DO NOT EXHIBIT THE DOMINANT ELECTRIC AND MAGNETIC SYMMETRY CONDITIONS HAVE BEEN EXCLUDED, BUT ARE KNOWN TO FOLLOW THE SAME GENERAL TREND. THE DOTTED VERTICAL LINE INDICATES THE GAP SIZE SELECTED FOR THE PROTOTYPE HORN DESIGN.

FIG. 7

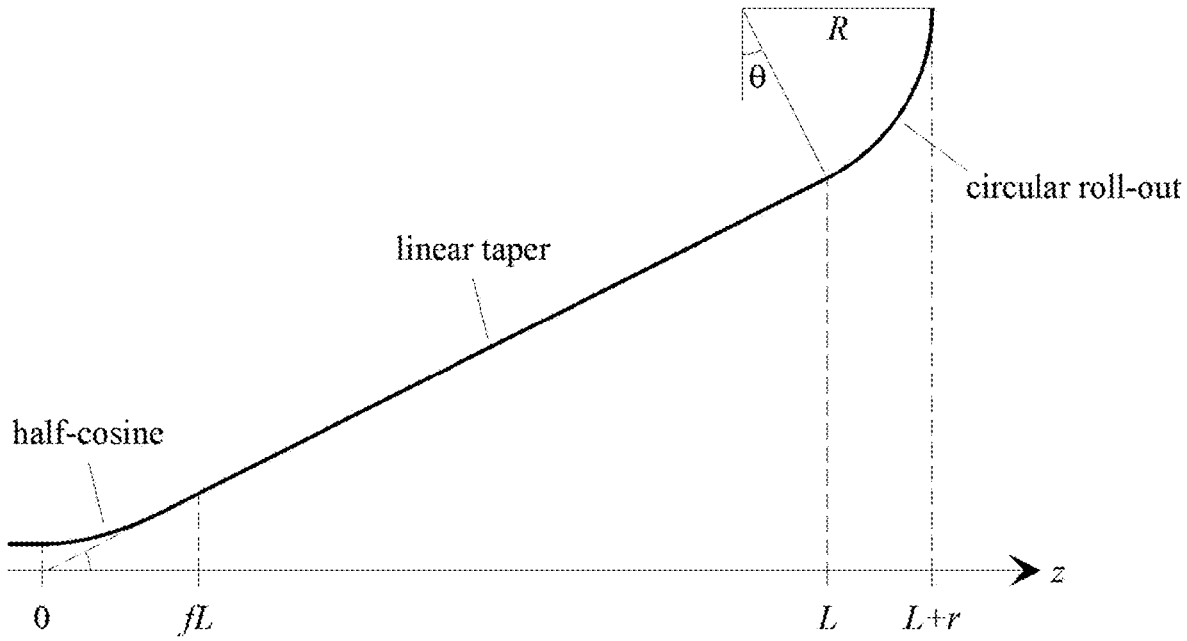
Figure 8. Diagram of the horn taper profile which applies to the outer dimensions, $a$ and $b$, as well as the ridge width, $w$. The gap dimension, $g$, is scaled against the height, $b$, according to a power law in order to ensure a monotonic decrease in cutoff frequencies for all modes.
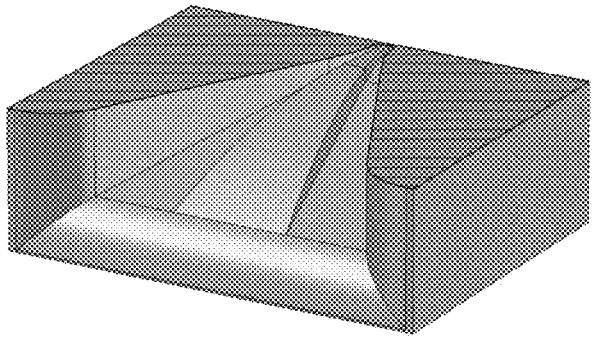
Figure 9. A cutaway view of the horn geometry (bottom half). The top-half is a mirrored copy.

A PLOT OF THE CUTOFF FREQUENCIES OF SEVERAL HIGHER-ORDER MODES AS A FUNCTION OF POSITION ALONG THE LONGITUDINAL AXIS OF THE HORN FROM THE LAUNCHER AT THE LEFT TO THE APERTURE AT THE RIGHT.

COMPLETED HORN ASSEMBLY

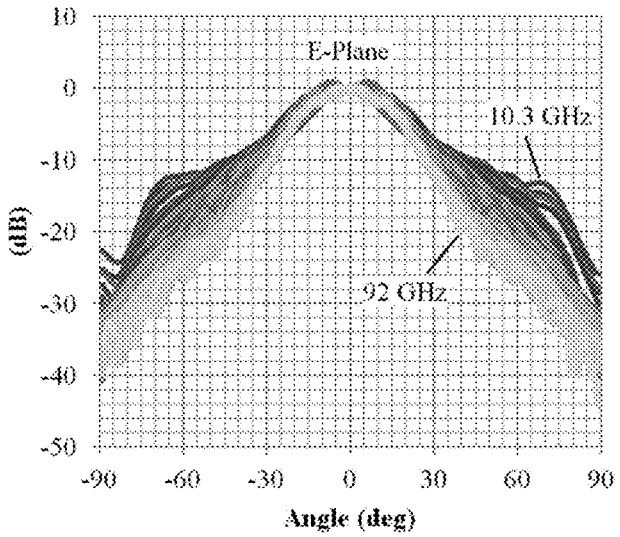
Figure 12. Measured E-Plane beam patterns for a 10-100 GHz launcher and horn.
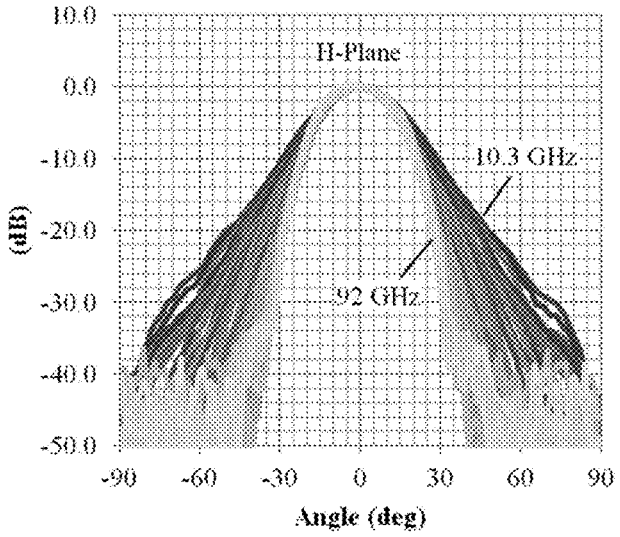
Figure 13. Measured H-Plane beam patterns for a 10-100 GHz launcher and horn.

DOUBLE-RIDGED WAVEGUIDE HORN ANTENNA

REFERENCE TO RELATED APPLICATIONS

This application is Divisional Application of U.S. Non-Provisional application Ser. No. 15/518,656, filed Apr. 12, 2018, entitled "TEM Line to Double-Ridged Waveguide Launcher," which is a National Stage Application of PCT Application No. PCT/US16/34573, filed May 27, 2016, entitled "TEM Line to Double-Ridged Waveguide Launcher and Horn Antenna," which claims priority to U.S. Provisional Application Nos. 62/167,687, filed May 28, 2015, and 62/312,235, filed Mar. 23, 2016, both entitled "TEM Line to Double-Ridged Waveguide Launcher and Horn Antenna." All are hereby specifically and entirely incorporated by reference.

RIGHTS IN THE INVENTION

This invention was made with government support under Cooperative Agreement AST-0223851, between the National Science Foundation and Associated Universities, Inc., and, accordingly, the United States government has certain rights in this invention.

BACKGROUND

1. Field

The invention is directed toward waveguide transitions, broadband antennas, and methods of their use. Specifically, the invention is directed toward double-ridged waveguide launchers and horn antennas.

2. Background

Broadband horn antennas are of significant interest in a number of test and measurement applications, as well as communication links, commercial and military radars, and scientific instrumentation. Many successful designs based on double-ridged geometry have been demonstrated in the cm-wave frequency band. Horns up to 18 GHz are especially common and readily available for purchase from commercial vendors. Very few such broadband horns, however, have extended much in to the millimeter-wave range, though some have been reported and are even commercially available at frequencies up to about 40 GHz. Among the challenges that make higher-frequency broadband implementations difficult is the launcher itself—that is, the broadband transition from coax or other Transverse Electric and Magnetic (TEM) transmission-line to the balanced double-ridged waveguide in the throat of the horn—and the avoidance of mode-resonances in the taper from the throat of the horn to the radiating aperture. Both of these tasks are made much harder by the relatively poor fabrication tolerance that is inevitably encountered at higher frequencies where the relevant structural features become microscopically small.

SUMMARY

The present invention addresses several of the challenges associated with conventional broadband launcher and horn designs, thereby providing a new resource for quasi-optical reception and transmission of electromagnetic waves, especially at sub-millimeter-wave and Terahertz frequencies where fabrication tolerances are relatively poor.

An embodiment of the invention is directed to a transition from TEM line to double-ridged waveguide, otherwise known as a launcher. The TEM line may be any form of transmission line that is either TEM or quasi-TEM, such as coaxial cable, microstrip, or stripline. The launcher comprises one or more probes extending across the gap between the ridges in double-ridged waveguide, a back-short section into which the ridges do not substantially extend, and a combiner connecting the probes to the desired TEM line. In this embodiment, preferably the backshort presents an approximate open-circuit to the probes over a wide range of frequencies, the probe or probes preferably substantially minimize the spreading inductance across the width of the ridges, and the combiner preferably transforms the collective impedance of the probes to that of the desired TEM line over a wide range of frequencies.

Another embodiment of the invention is directed to the taper of a horn from double-ridged waveguide to a radiating aperture. Starting with the cross-sectional dimensions of a double-ridged waveguide in the throat of the horn as a reference, the width, height, and ridge-width preferably increase smoothly and monotonically along the length of the horn to the aperture. The gap-to-height ratio preferably scales up along the majority of the length of the horn according to a power law with respect to the other dimensions. This tends to ensure that the cutoff frequencies of higher-order modes decrease in a substantially monotonic fashion along the length of the horn, avoiding the appearance of mode-resonances even in the presence of small fabrication errors or unintentional asymmetry.

DESCRIPTION OF THE DRAWINGS

The invention is described in greater detail by way of example only and with reference to the attached drawings, in which:

FIG. 1. Illustration of the current density on the surface of one ridge in a double-ridged waveguide launcher near a single excitation probe (top-down view).

FIG. 2. Illustration of the current density on the surface of one ridge in a double-ridged waveguide launcher near two excitation probes (top-down view).

FIG. 3. Model of two-probe launcher with impedance-matching combiner in microstrip.

FIG. 6. Close-up of bond-wire coupling posts crossing the ridge gap.

FIG. 7. Mode cutoff frequencies versus gap height ratio (b/g) for double-ridged waveguide, normalized to the cutoff of the dominant mode. a/b=1.7 and w/b=0.7. Modes which do no exhibit the dominant electric and magnetic symmetry conditions have been excluded, but are known to follow the same general trend. The dotted vertical line indicates the gap size selected for the prototype horn design.

FIG. 8. Diagram of the horn taper profile which applies to the outer dimensions, a and b, as well as the ridge width, w. The gap dimension, g, is scaled against the height, b, according to a power law in order to ensure a monotonic decrease in cutoff frequencies for all modes.

FIG. 9. A cutaway view of the horn geometry (bottom half). The top-half is a mirrored copy.

FIG. 12. Measured E-Plane beam patterns for a 10-100 GHz launcher and horn.

FIG. 13. Measured H-Plane beam patterns for a 10-100 GHz launcher and horn.

DETAILED DESCRIPTION

As embodied and broadly described herein, the disclosures herein provide detailed embodiments of the invention. However, the disclosed embodiments are merely exemplary of the invention that can be embodied in various and alternative forms. Therefore, there is no intent that specific structural and functional details should be limiting, but rather the intention is that they provide a basis for the claims and as a representative basis for teaching one skilled in the art to variously employ the present invention.

A problem in the art capable of being solved by the embodiments of the present invention is a TEM line to double-ridged waveguide launcher that is well-matched over a broad range of frequencies. In some embodiments, the TEM line (or quasi-TEM line) may be microstrip line, stripline, suspended stripline, slotline, coplanar waveguide, grounded coplanar waveguide, twin line, or coaxial line. A conventional approach uses a single field probe that spans the gap in a double-ridged waveguide, as shown in FIG. 1, a cutaway top-down view wherein the ridge runs vertically toward the waveguide output at the top of the figure, the backshort is at the bottom, the small white dot indicates the position of the field probe, and the shading indicates the current density on the ridge. The dotted lines highlight the spreading of the current away from the field probe to fill the width of the ridge so as to couple into the dominant waveguide mode. It is surprisingly found in simulation that this feature leads to a nearly constant inductive reactance—equivalently, a frequency-dependent inductance—which makes the transition very difficult to match over a broad range of frequencies. In a preferred embodiment of the present invention, multiple probes are used at the TEM-ridge junction in order to distribute the current more evenly across the width of the ridge, thus minimizing this spreading inductance, as illustrated in FIG. 2. In another preferred embodiment, the probe or probes have a wide aspect ratio, such as a beam lead, that further minimizes the spreading inductance of the transition.

In a preferred embodiment, the collective parallel impedance of the multiple probes is matched to that of the desired input TEM or quasi-TEM transmission line. A TEM or quasi-TEM combiner may be used for this purpose. In a preferred embodiment, this combiner may take the form of a printed circuit, as shown in the model of FIG. 3. In order to match the impedance over a 10:1 bandwidth in this example, the combiner employs a gradual impedance taper from the probes to the input connector. In some embodiments, the combiner may also employ isolation resistors to attenuate differential modes on the probes.

Figure 4:
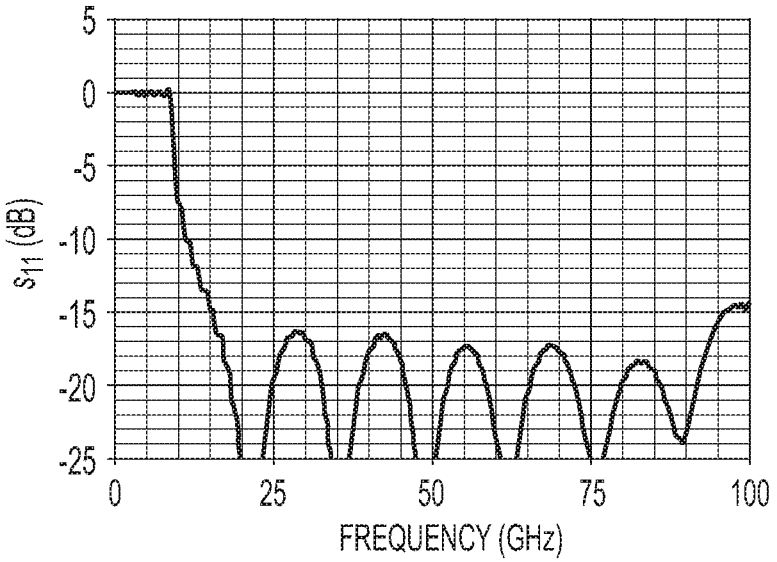
FIG. 4. Simulated performance of two-probe launcher design.

The backshort in some preferred embodiments comprises a rectangular waveguide wherein one or more of the ridges are substantially absent. In other embodiments, backshorts may have different geometries, such as circular waveguide. The backshort preferably presents a near open-circuit impedance to the probes over a broad range of frequencies. Simulated performance of the illustrated embodiment of the launcher is shown in FIG. 4. Note that abrupt low-frequency cutoff of the return loss, and the extended matched performance over a 10:1 bandwidth.

Figure 5:
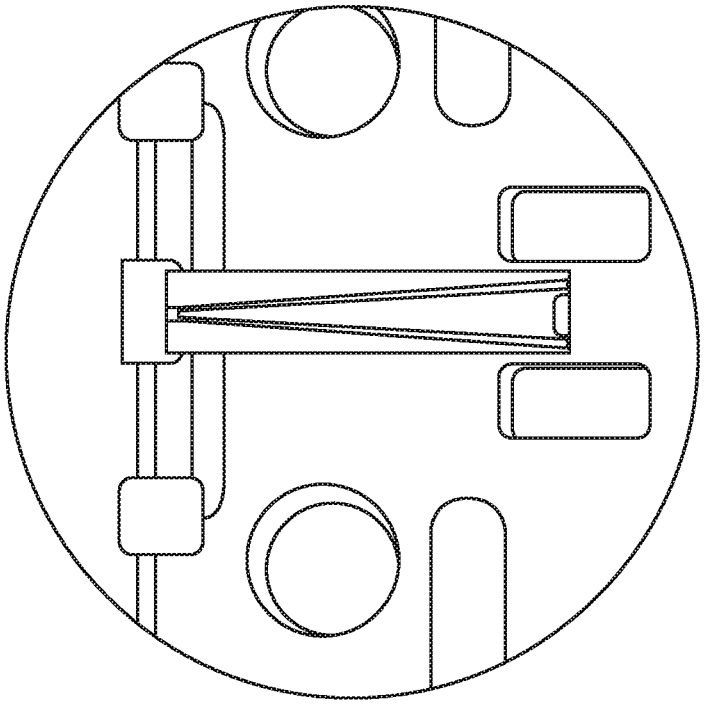
FIG. 5. Photograph of launcher assembly with quartz splitter.

As an example of one embodiment of this invention, a prototype launcher was constructed. Photographs of the interior details are shown in FIGS. 5 and 6. The probes themselves in this embodiment comprise triple bond-wires extending from the printed circuit combiner across the gap to the ridge on the other side. In this embodiment, the combination of three bond wires in parallel preferably increases the effective width of the filed probe, helping to minimize the spreading inductance. In other embodiments, the probes may comprise pins, beam leads, or traces on a printed circuit board. The probes may be DC grounded to the chassis on the opposing ridge, as in this example, or they may be AC-coupled, as in a capacitively coupled-probe or other electrically small antenna.

Another problem in the art capable of being solved by the embodiments of the present invention is a horn taper from double-ridged waveguide to radiating aperture which has nearly constant directivity over a broad range of frequencies and does not exhibit undesirable mode-resonances. It is useful to consider how the mode cutoff frequencies behave as a function of double-ridged waveguide geometry, as illustrated in FIG. 7. The cross-sectional dimensions of the waveguide are defined in the inset of the figure. In this plot, the cutoff frequencies are normalized to that of the dominant mode, and the independent variable is the waveguide height-to-gap ratio, or b/g. In a preferred embodiment, the dimensions of the throat section of the horn are selected to be free of higher-order modes (or at least, free of higher-order modes that are not excluded by symmetry conditions) over the desired operating bandwidth. This is indicated by the dotted vertical line, at which the first higher-order mode is more than a decade above the dominant mode. In a preferred embodiment, the waveguide dimensions will trend toward larger values and larger relative gap size (toward the left side of the plot) nearer to the radiating aperture.

It is noteworthy in the plot of FIG. 7 that as the gap becomes small (toward the right side of the plot) the higher-order modes trend linearly upward on a log-log scale. This indicates an approximately power-law dependence upon the gap size. Thus, to ensure monotonicity of the changing mode cutoff frequencies along the length of the horn, one may enforce a roughly power-law scaling of the gap dimension, relative to the other dimensions of the waveguide, throughout most of the tapered section. This monotonicity is key to avoiding trapped-mode resonances in such a structure, which become especially problematic at high frequencies where fabrication tolerances are most difficult to achieve.

In a preferred embodiment, all dimensions except for the gap (i.e. the ridge width and outer waveguide dimensions) scale proportionately with one another along the length of the horn. It is preferable if the profile of these dimensions is smooth, having no discontinuities in either value or slope, to achieve good return loss. A linear taper over the majority of the length of the horn is preferred to keep the directivity of the horn constant over a wide range of frequencies. Additionally, it is preferred that the outer dimensions "roll-out" at the last section of the taper to aid the electromagnetic waves in detaching from the waveguide walls, a technique known in the art as "aperture-matching." This combination of preferred features is achieved with the taper profile shown in FIG. 8. It begins with a half-cosine profile to transition from straight (un-tapered) waveguide into the tapered section without introducing a break in the slope. In other words, the dimensional parameters, a, b, and w, corresponding to the width, height, and ridge width, respectively, may be described as a function of z along the axis of the horn as follows, $$a(z) = \begin{cases} ha_2 + (a_1 - ha_2)\cos\left(\frac{\pi}{2}\frac{z}{fL}\right) & 0 \le z < fL \\ a_2\left(h + \frac{1-h}{1-f}\frac{z-fL}{L}\right) & fL \le z \le L \end{cases} \tag{1a}$$

$$b(z) = \begin{cases} hb_2 + (b_1 - hb_2)\cos\left(\frac{\pi}{2}\frac{z}{fL}\right) & 0 \le z < fL \\ b_2\left(h + \frac{1-h}{1-f}\frac{z-fL}{L}\right) & fL \le z \le L \end{cases} \tag{1b}$$

$$w(z) = \begin{cases} hw_2 + (w_1 - hw_2)\cos\left(\frac{\pi}{2}\frac{z}{fL}\right) & 0 \le z < fL \\ w_2\left(h + \frac{1-h}{1-f}\frac{z-fL}{L}\right) & fL \le z \le L \end{cases} \tag{1c}$$

where $a_1$, $b_1$, and $w_1$ are the dimensions of the input waveguide, $a_2$, $b_2$, and $w_2$ are the dimensions at the aperture, f is the fraction of the total length of the taper that is occupied by the half-cosine section, and h is the fraction of the total aperture dimension that it attains, given by $$h = \frac{1 + \frac{1}{s}\frac{\pi}{2}\left(\frac{1}{f} - 1\right)}{1 + \frac{\pi}{2}\left(\frac{1}{f} - 1\right)}. \tag{2}$$

Note that s is the scale factor relating the aperture dimensions to the waveguide throat dimensions. That is, $a_2 = sa_1$, $b_2 = sb_1$, and $w_2 = sw_1$.

In a preferred embodiment, the taper continues after the half-cosine section with a linear taper over the majority of the horns length, to achieve the desired constant directivity. Finally, the aperture-matched "roll-out" is achieved with a sub-quarter-turn circular section that terminates in a plane perpendicular to the long axis of the horn. A single parameter, r, specifies the longitudinal extent of the circular arc around the periphery. In order for the slope of the walls to be continuous, this requires a different roll angle, θ, and radius, R, for the E- and H-planes, given by $$\tan\theta_a = \frac{a_2}{2L}\left(\frac{1-h}{1-f}\right) \tag{3a}$$

$$\tan\theta_b = \frac{b_2}{2L}\left(\frac{1-h}{1-f}\right) \tag{3b}$$

$$R_a = \frac{r}{1 - \sin\theta_a} \tag{3c}$$

$$R_b = \frac{r}{1 - \sin\theta_b}. \tag{3d}$$

As described in this preferred embodiment, this profile is used for all double-ridged waveguide dimensions except for the gap. The gap, as described previously, scales according to a power-law relative to the other dimensions in order to preserve the monotonicity of the higher-order mode cutoff frequencies and avoid trapped-mode resonances. Thus, $$g(z) = cb^p(z) \tag{4}$$

where $$p = \frac{\ln\left(\frac{g_2}{g_1}\right)}{\ln\left(\frac{b_2}{b_1}\right)} \tag{5a}$$

$$c = g_1 b_1^{-p}. \tag{5b}$$

Figure 10:
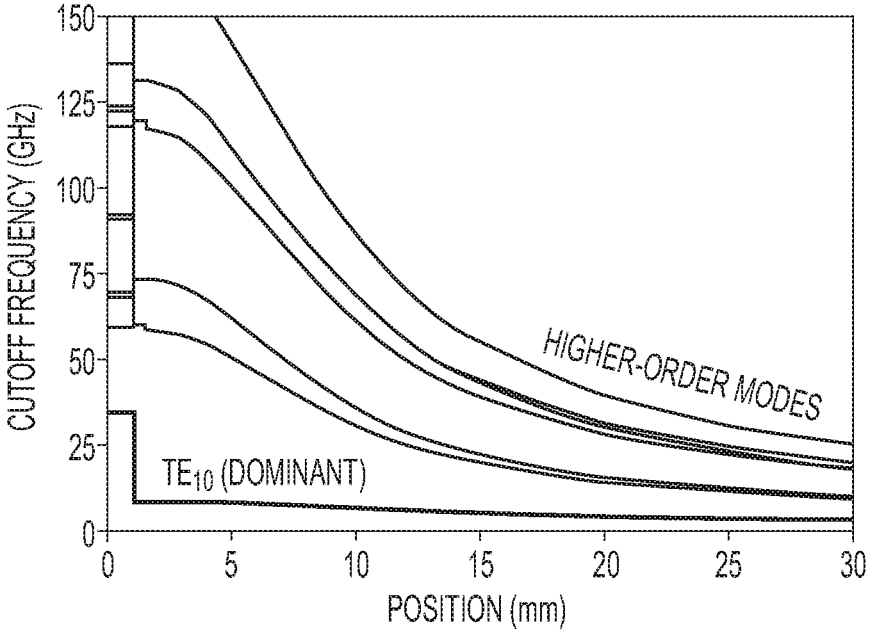
FIG. 10. A plot of the cutoff frequencies of several higher-order modes as a function of position along the longitudinal axis of the horn, from the launcher at the left to the aperture at the right.

In a preferred embodiment, the gap dimension becomes substantially equal to the waveguide height at the aperture of the horn ($g_2 = b_2$). The resulting three-dimensional structure is illustrated in FIG. 9. This cutaway view shows only the bottom half of the horn; the top-half is a mirror-image of this. A plot of the mode cutoff frequencies along the length of the horn, illustrating the monotonic trend which is key to the resonance-free performance of this horn, is shown in FIG. 10.

Figure 11:
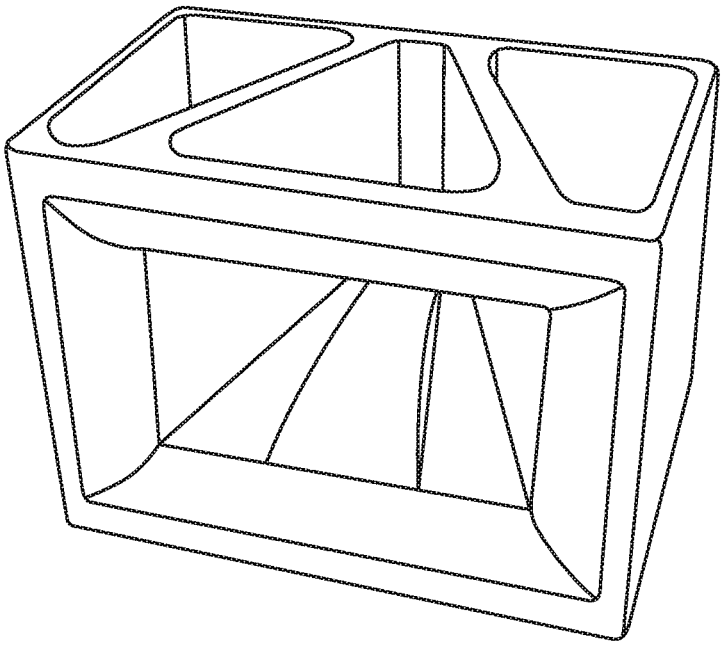
FIG. 11. Photograph of the completed horn assembly.

In a preferred embodiment, the launcher and the horn, both previously described, may be combined to make a complete horn antenna assembly which is manufacturable at high frequencies, as demonstrated by the prototype shown in the photograph of FIG. 11. Measured beam patterns for this horn are shown in FIGS. 12 and 13.

In preferred embodiments, the horn and launcher assembly may further comprise active electronic devices such as diodes, transistors, tunnel junctions, or more complex integrated circuits. This integrated assembly may be a detector, or a transmitter, or a noise source.

Other embodiments and uses of the invention will be apparent to those skilled in the art from consideration of the specification and practice of the invention disclosed herein. All references cited herein, including all publications, U.S. and foreign patents and patent applications, are specifically and entirely incorporated by reference. It is intended that the specification and examples be considered exemplary only with the true scope and spirit of the invention indicated by the following claims. Furthermore, the term "comprising of" includes the terms "consisting of" and "consisting essentially of."

The invention claimed is:

1. A horn antenna, comprising:

a double-ridged waveguide input, having dimensions of width, a, and height, b, where the width and height comprise waveguide outer dimensions, and internal ridges having ridge width, w, with a gap dimension, g, between the ridges; and a radiating aperture;

wherein the waveguide outer dimensions, a and b, and ridge width, w, increase smoothly and monotonically over a length of the horn from the double-ridged waveguide input to the radiating aperture; and wherein the gap dimension, g, is given mathematically by one or more of the other waveguide dimensions (a, b, or w) raised to a power, p, over a majority of the length of the horn.

2. The horn of claim 1, wherein the radiating aperture is aperture-matched.

3. The horn of claim 2, wherein the aperture-matching comprises an approximately quarter-turn rollout in the outer waveguide dimensions.

4. The horn of claim 1, wherein the waveguide outer dimensions and ridge width scale proportionately to one another over a majority of the length of the horn.

5. The horn of claim 1, wherein the waveguide outer dimensions and ridge width follow a half-cosine taper over an initial length of the horn.

6. The horn of claim 1, wherein the waveguide outer dimensions and ridge width follow a linear taper over the majority of the length of the horn.

7. The horn of claim 1, wherein the gap dimension becomes equal to the waveguide height at the aperture of the horn.

8. The horn in claim 1, wherein the cutoff frequencies of a majority of all propagating modes vary monotonically over a majority of the length of the horn.

9. The horn in claim 1, wherein the waveguide dimensions have no discontinuities or breaks in the slope over a majority of the length of the horn.

10. The horn in claim 1, wherein the waveguide dimensions follow a compound taper involving one or more of half-cosine profiles, linear profiles, circular profiles, and power-law profiles.

11. The horn in claim 1, wherein one or more of the aperture dimensions, the waveguide dimensions, and the horn length are selected to equalize the width of the beam patterns in the E- and H-planes.

12. An assembly comprising a Transverse Electric and Magnetic (TEM) transmission line (TEM line) or quasi-TEM line to double-ridged waveguide launcher and a horn antenna, wherein a double-ridged waveguide in both the launcher and the horn antenna has dimensions of width, a, and height, b, where the width and height comprise waveguide outer dimensions, and internal ridges having ridge width, w, with a gap, g, between the ridges;

the launcher comprising:

one or more probes extending across the gap, g, in a double-ridged waveguide;

a waveguide backshort; and a TEM combiner or matching taper;

wherein one or more of the ridges of the double-ridged waveguide do not extend into the backshort;

wherein the backshort provides a near open-circuit to the probes over a wide range of frequencies;

wherein each probe is adapted to minimize spreading inductance of currents in the launcher across the width, w, of the ridges of the double-ridged waveguide; and wherein the TEM combiner matches the collective an impedance of the probes to the TEM line; and the horn antenna comprising:

a double-ridged waveguide input; and a radiating aperture;

wherein the waveguide outer dimensions, a and b, and ridge width, w, increase smoothly and monotonically over a length of the horn from the double-ridged waveguide input to the radiating aperture; and wherein the gap, g, is given mathematically by one or more of the other waveguide dimensions (a, b, or w) raised to a power, p, over a majority of the length of the horn.

13. The assembly in claim 12, wherein the assembly integrates an electronic device.

14. The assembly in claim 13 wherein the electronic device is one of a diode, a transistor, a tunnel junction, and an integrated circuit.

15. The assembly in claim 12, wherein the assembly is one of a detector, a transmitter, and a noise source.

* * * * *